United States Patent [19]

Riksford

[11] Patent Number: 4,774,869

[45] Date of Patent: Oct. 4, 1988

[54] MULTI-FLAG MARCHING BATON

[76] Inventor: Jon Riksford, 632 Wildflower Pl., Escondido, Calif. 92026

[21] Appl. No.: 157,595

[22] Filed: Feb. 19, 1988

[51] Int. Cl.[4] ..... G10G 7/00

[52] U.S. Cl. ..... 84/477 B

[58] Field of Search ..... 84/477 B

[56] References Cited

U.S. PATENT DOCUMENTS 2,255,352 9/1941 Greenquist et al. ..... 84/477 B 3,354,770 11/1967 Haug ..... 84/477 B

*Primary Examiner*—Lawrence R. Franklin

*Attorney, Agent, or Firm*—Charles C. Logan, II

[57] ABSTRACT

A multi-flag marching baton formed from an elongated tubular sleeve within which an elongated member is telescopically received. There is a space between the inside wall surface of the tubular sleeve and the outer surface of the elongated member to form an annularly shaped flag storage chamber. A strap passes along the outside length of the tubular sleeve and has its opposite ends attached adjacent one end of the elongated member. A first display flag is secured to this strap. A second display strap is secured to the elongated member. When the elongated member is telescopically withdrawn from one end of the tubular sleeve, the second flag will be withdrawn from the flag storage chamber within the tubular sleeve and unfurled for display while at the same time the first display flag that is attached to the strap will be drawn into the opposite end of the tubular sleeve and its flag compressed into the flag storage chamber.

5 Claims, 1 Drawing Sheet

MULTI-FLAG MARCHING BATON

BACKGROUND OF THE INVENTION

The invention relates to a marching baton and more specifically to one having two display flags that can be alternately displayed while the other is stored within the baton.

In the past marching groups and drill teams such as found in high schools have utilized flags mounted on poles in their performances. These prior art flags do not incorporate structure in their poles for storing the unfurled flag nor do they have multiple flags attached to their pole structure.

It is an object of the invention or provide a novel multi-flag marching baton that has structure for alternately storing one flag while displaying a second flag.

It is also an object of the invention to provide a novel multi-flag marching baton that effectively eliminates the need for a second flag and supporting structure therefore.

It is another object of the invention to provide a novel multi-flag marching baton that is economical to manufacture and market.

It is a further object of the invention to provide a novel multi-flag marching baton that is formed of lightweight material and which is easy to use in making precision drill team movements.

It is an additional object of the invention to provide a novel multi-flag marching baton that will enable one piece of auxillary corps equipment to function in multiple configurations.

SUMMARY OF THE INVENTION

Applicant's novel multi-flag marching baton has been designed so that it can alternatively first display its one flag while the other flag is stored within and then by pulling its telescoping members apart to display the second flag while causing the first flag to be stored within the baton itself. The structure which allows this to be accomplished basically consists of an elongated tubular sleeve and an elongated tubular member that telescopes within the tubular sleeve. There is a sufficient open space between the outer surface of the elongated tubular member and the inside surface of the tubular sleeve to form an annularly shaped flag storage chamber.

A predetermined length of strap extends along the entire outer surface of the tubular sleeve and has its one end passing up through the flag storage chamber within the tubular sleeve so that the opposite ends of the strap may be attached adjacent the same end of the elongated tubular member. A first display flag has one of its edges sewn onto the strap at a predetermined location so that it is unfurled and fully visible. At this time a second display flag has one of its edges attached to the internally located elongated tubular member and it would be in its stored state within the flag storage chamber. As the elongated tubular member is telescopically withdrawn from the one end of the tubular sleeve, the second display flag will be withdrawn from the flag storage chamber and unfurled for display while at the same time the first display flag that is attached to the strap will be drawn into the opposite end of the tubular sleeve and into the flag storage chamber. This allows two distinct flags or banners to be utilized with a single piece of equipment.

The tubular sleeve of the tubular member that telescopes therewithin would be preferably made of aluminum material or some other lightweight material. The flags would be made of fabric material and the strap would normally be made of woven nylon. The remaining fastening structure and end caps would also be made of plastic material when possible to keep the weight of the baton as light as possible.

Since one of the display flags is attached by Velcro fastening structure to the elongated tubular member and the other display flag is attached to the strap, it is a simple matter in order to interchange other display flags that have similar attaching structure.

DESCRIPTION OF THE PREFERRED EMBODIMENT

Figure 1:
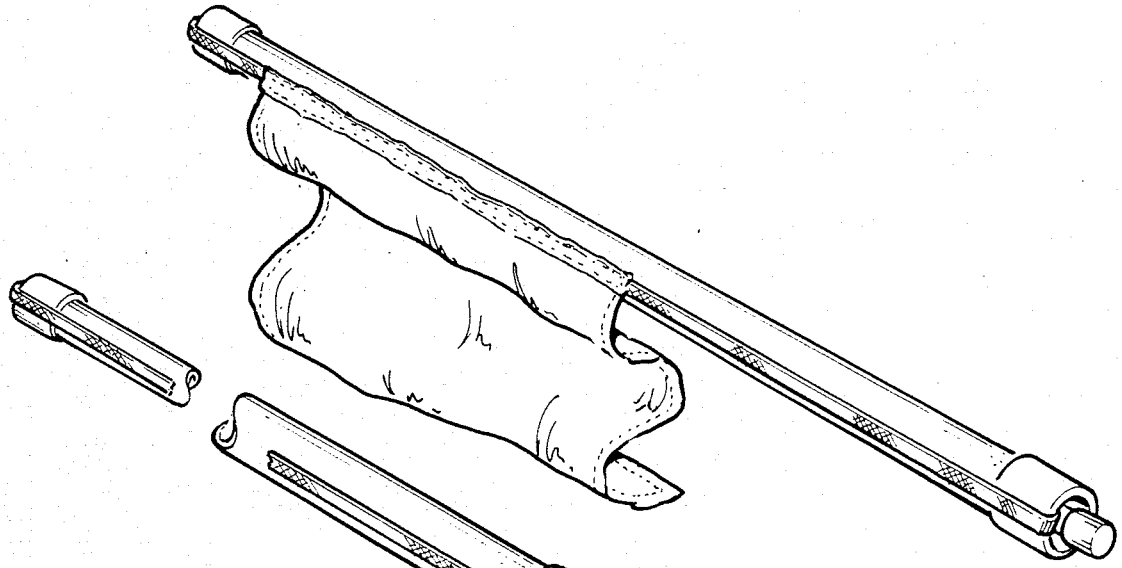
FIG. 1 is a perspective view of applicant's novel multi-flag marching baton with its first flag being displayed.
Figure 2:
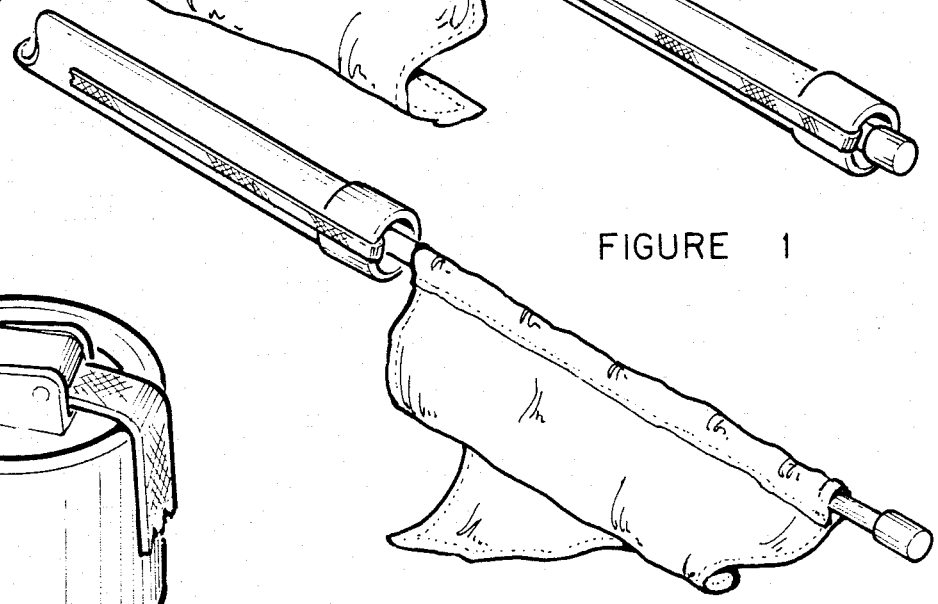
FIG. 2 is a perspective view of the multi-flag marching baton with the internal tubular member in its telescopically extended position and displaying the second display flag.
Figure 3:
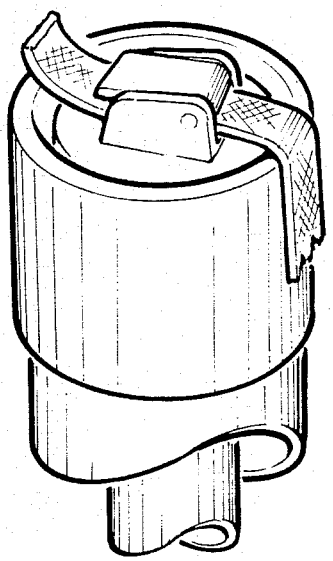
FIG. 3 is a perspective view of the one end of the multi-flag marching baton.
Figure 4:
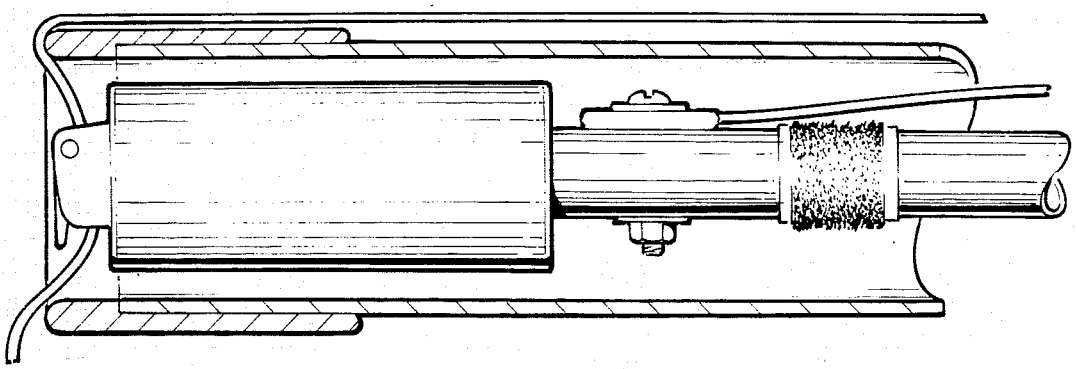
FIG. 4 is a vertical crosssectional view of one end of the multi-flag marching baton.

Applicant's novel multi-flag marching baton will now be described by referring to FIGS. 1–4 of the drawing. The marching baton is generally designated numeral 10.

Marching baton 10 is formed from a tubular sleeve 12 having end sleeve caps 13 and 14 on its respective ends. It has an elongated cylindrical member 16 normally telescoped therien and an annularly shaped flag storage chamber 18 is formed between the outside surface of cylindrical member 16 and the inside wall surface of tubular sleeve 12.

The strap 20 of webbing material has a reinforced tip pad 21 formed on its one end that is secured to cylindrical member 16 by a bolt 23, washer 24 and nut 25. The opposite end of strap 20 is threaded through webbing clamp assembly 28 and locked in position by clamp lever 29. Webbing clamp assembly 28 is secured to primary end cap 32 which in turn is attached to one end of cylindrical member 16.

A secondary end cap 33 is secured to the opposite end of cylindrical member 16.

A first display flag 36 has its attachment edge 37 attached to strap 20 by stitching 38. Second display flag 40 has an attaching edge 41 looped upon itself to provide a closed loop through which cylindrical member 16 may be telescoped. The opposite ends of attachment edge 41 have Velcro strip hook and loop fastener strips sewn thereto and these matingly fasten to Velcro strip fasteners 50 that are secured at spaced positions on cylindrical member 16.

What is claimed is:

1. A multi-flag marching baton comprising:

an elongated tubular sleeve having a predetermined length and a predetermined internal diameter, said tubular sleeve having a first end and a second end;

an elongated member having a first end and a second end, said elongated member being telescopically received in said tubular sleeve, the width of said elongated member being sufficiently smaller than the internal diameter of said tubular sleeve to form a flag storage chamber therebetween;

a first display flag having an attachment edge;

a second display flag having an attachment edge;

means for attaching said second display flag to said elongated member;

a predetermined length of strap having a first end and a second end, said strap having a portion of its length passing along the entire length of the outside surface of said tubular sleeve and having its first and second ends attached to said elongated member adjacent its first end, the attachment edge of said first display flag being secured to said strap at a predetermined location so that when the second end of said elongated member is telescopically withdrawn from the second end of said tubular sleeve said second flag will be withdrawn from the flag storage chamber within said tubular sleeve and unfurled for display while at the same time the first display flag that is attached to said strap will be drawn into the first end of said tubular sleeve and its flag storage chamber.

2. A multi-flag marching baton as recited in claim 1 wherein said elongated member is tubular and it has a primary end cap and a secondary end cap.

3. A multi-flag marching baton as recited in claim 2 wherein said primary end cap has a webbing clamp assembly secured thereto for detachably securing one end of said strap to said elongated member.

4. A multi-flag marching baton as recited in claim 1 wherein said first display flag is attached to said strap by stitching.

5. A multi-flag marching baton as recited in claim 1 wherein said means for attaching said second display flag comprises a pair of Velcro strips sewn into the attachment edge of said second display flag and a pair of Velcro strips secured to said elongated member.

* * * * *